US007412321B2

(12) United States Patent
de Sylva

(10) Patent No.: US 7,412,321 B2
(45) Date of Patent: Aug. 12, 2008

(54) SYSTEM AND METHOD FOR SELECTIVELY DISABLING A VEHICLE

(76) Inventor: Robert F. de Sylva, 161 Ocean Park Blvd., #D, Santa Monica, CA (US) 90405

( * ) Notice: Subject to any disclaimer, the term of this patent is extended or adjusted under 35 U.S.C. 154(b) by 418 days.

(21) Appl. No.: 10/641,064

(22) Filed: Aug. 14, 2003

(65) Prior Publication Data

US 2005/0038592 A1 Feb. 17, 2005

(51) Int. Cl.
*G06G 7/70* (2006.01)
*G06F 19/00* (2006.01)

(52) U.S. Cl. ..... 701/101; 701/213; 340/406.11

(58) Field of Classification Search ..... 701/101, 701/102, 103, 36, 49, 202, 209, 213; 340/406.11, 340/406.12; 307/10.2; 89/1.11
See application file for complete search history.

(56) References Cited

U.S. PATENT DOCUMENTS 5,142,984 A * 9/1992 Stearns et al. ..... 102/213
5,343,043 A * 8/1994 Johnson ..... 250/338.5
5,839,081 A * 11/1998 Joao et al. ..... 701/36
5,917,406 A * 6/1999 Postel ..... 340/426.12
5,952,600 A * 9/1999 Herr ..... 89/1.11
6,072,248 A * 6/2000 Muise et al. ..... 307/10.2
6,131,060 A * 10/2000 Obradovich et al. ..... 701/49
6,240,365 B1 * 5/2001 Bunn ..... 701/213
6,650,283 B2 * 11/2003 Brydges et al. ..... 342/357.07
6,715,395 B1 * 4/2004 Heibel ..... 89/1.11
6,739,311 B1 * 5/2004 Kingsley ..... 123/323

FOREIGN PATENT DOCUMENTS

FR 002761182 A1 * 9/1998

* cited by examiner

*Primary Examiner*—Willis R. Wolfe, Jr.
*Assistant Examiner*—Johnny H. Hoang

(57) ABSTRACT

A system for selectively disabling a vehicle. In the illustrative embodiment, the system adapted to prevent high-speed automotive chases. The system includes a first mechanism for locating vehicle to be disabled. A second mechanism launches a disabling projectile toward the vehicle. A third mechanism employs the projectile to disable the vehicle by suffocating an engine of the vehicle or otherwise compromising the fuel/air mixture. In a specific embodiment, and an infrared guidance system guides the projectile toward a muffler of the vehicle, and a muffler-plugging agent incorporated within the projectile plugs a muffler.

30 Claims, 4 Drawing Sheets

SYSTEM AND METHOD FOR SELECTIVELY DISABLING A VEHICLE

BACKGROUND OF THE INVENTION

1. Field of Invention

This invention relates to suspect apprehension. Specifically, the present invention relates to systems and methods for remotely disabling and/or tracking vehicles employed by fleeing suspects or other persons of interest.

2. Description of the Related Art

Systems for facilitating suspect apprehension are employed in various applications including law enforcement and military operations. Such applications demand efficient mechanisms to facilitate apprehending suspects without undue danger to bystanders, pursuers, or the suspect(s).

Systems for facilitating suspect apprehension are particularly important during high-speed chases, where fleeing suspects create an extreme safety hazard. Conventionally, pursuing agents, such as law enforcement officers, simply chase the suspect via one or more police vehicles, attempting to corner the suspect or force the suspect to run out of gas. Unfortunately, these methods are undesirably dangerous. Accordingly, more local governments are opting to outlaw high-speed chases and instead, let the suspects escape.

To reduce the duration of high-speed chases and thereby reduce accompanying risks, road spikes are sometimes employed. However, pursuers must either guess where the suspect will flee and then place spikes accordingly, or they must divert the suspect to the desired road equipped with the spikes. Unfortunately, suspect movement is often unpredictable, and innocent persons may be killed before the fleeing suspect reaches the road spikes. Furthermore, even after hitting road spikes, suspects often continue the chase with flat tires, which may increase danger to innocents, since vehicles becomes less controllable without tires.

To reduce pressure on pursuing agents to closely trail fleeing suspects, systems for tracking the suspects' locations may be employed. Such systems, such as those disclosed in U.S. Pat. No. 6,246,323, entitled METHOD AND SYSTEM FOR TRACKING A VEHICLE, employ a transmitter embedded in a carrier that sticks on the vehicle when launched at the vehicle. The transmitter broadcasts a signal that enables pursuing agents to track the fleeing vehicle. However, law enforcement agents relying on these systems may be less likely to maintain visual contact with the suspects. Consequently, suspects may more readily escape by parking their vehicles and fleeing. This is particularly true in urban environments, where a fleeing suspect can blend with a crowd and where high-speed chases are more dangerous. This is especially problematic when the fleeing suspect is wanted for a serious crime.

Furthermore, use of such tagging trackers may not end the chase. If the suspect is a murder or other dangerous criminal that must be apprehended, pursuing agents may still attempt to maintain visual contact with the fleeing suspect. Consequently, the pursuits may remain undesirably dangerous despite the use of the trackers.

Alternatively, systems for remotely controlling vehicles, as described in U.S. Pat. No. 6,411,887, entitled METHOD AND APPARATUS FOR REMOTELY CONTROLLING MOTOR VEHICLES, and U.S. Pat. No. 6,470,260, of the same title, may sometimes be employed. These systems include a device for sending control signals to control modules contained in the pursued vehicle. Unfortunately, pursued vehicles rarely have such control modules installed, and a clever suspect could conceivably disable such modules before or during the chase.

The art is crowded with systems that attempt to disable fleeing vehicles. One such system is disclosed in U.S. Pat. No. 5,503,059, entitled VEHICLE DISABLING DEVICE AND METHOD. Unfortunately, such systems often require equipment, such as remote-controlled vehicle-disabling devices, which often do not exist on fleeing suspect vehicles. Accordingly, these devices are not widely used by law enforcement.

Hence, a long-felt unsolved need remains for an efficient system and method for facilitating apprehending persons fleeing by vehicle while minimizing danger to innocent bystanders and maximizing chances that the suspects are caught.

SUMMARY OF THE INVENTION

The need in the art is addressed by the system for selectively disabling a vehicle of the present invention. In the illustrative embodiment, the system adapted to prevent high-speed automotive chases. The device includes first mechanism for locating the fleeing vehicle. A second mechanism launches a disabling projectile toward the fleeing vehicle. A third mechanism employs the projectile to disable the vehicle by suffocating an engine of the vehicle or otherwise compromising the fuel/air mixture.

In a specific embodiment, a fourth mechanism plugs a muffler of the vehicle and includes a muffler-plugging agent incorporated within the projectile. A fifth mechanism guides the projectile toward the muffler and includes an infrared guidance system.

In a more specific embodiment, the third mechanism includes a gas incorporated within the projectile. The gas is sufficient to stall the vehicle upon or after entering an engine of the vehicle. A sixth mechanism selectively disperses the gas upon or after impact of the projectile with the vehicle. The projectile includes a sticky substance for adhering the projectile to the vehicle. A seventh mechanism directs the projectile into an aperture of the muffler, thereby at least partially plugging the muffler.

The novel design of the present invention is facilitated by the second and third mechanisms, which employ a projectile to plug a vehicle muffler or air intake and/or to introduce an engine-stalling gas into the engine of the vehicle. Hence, the system may be readily employed to stop most existing automobiles without relying on pre-installed equipment.

DESCRIPTION OF THE INVENTION

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
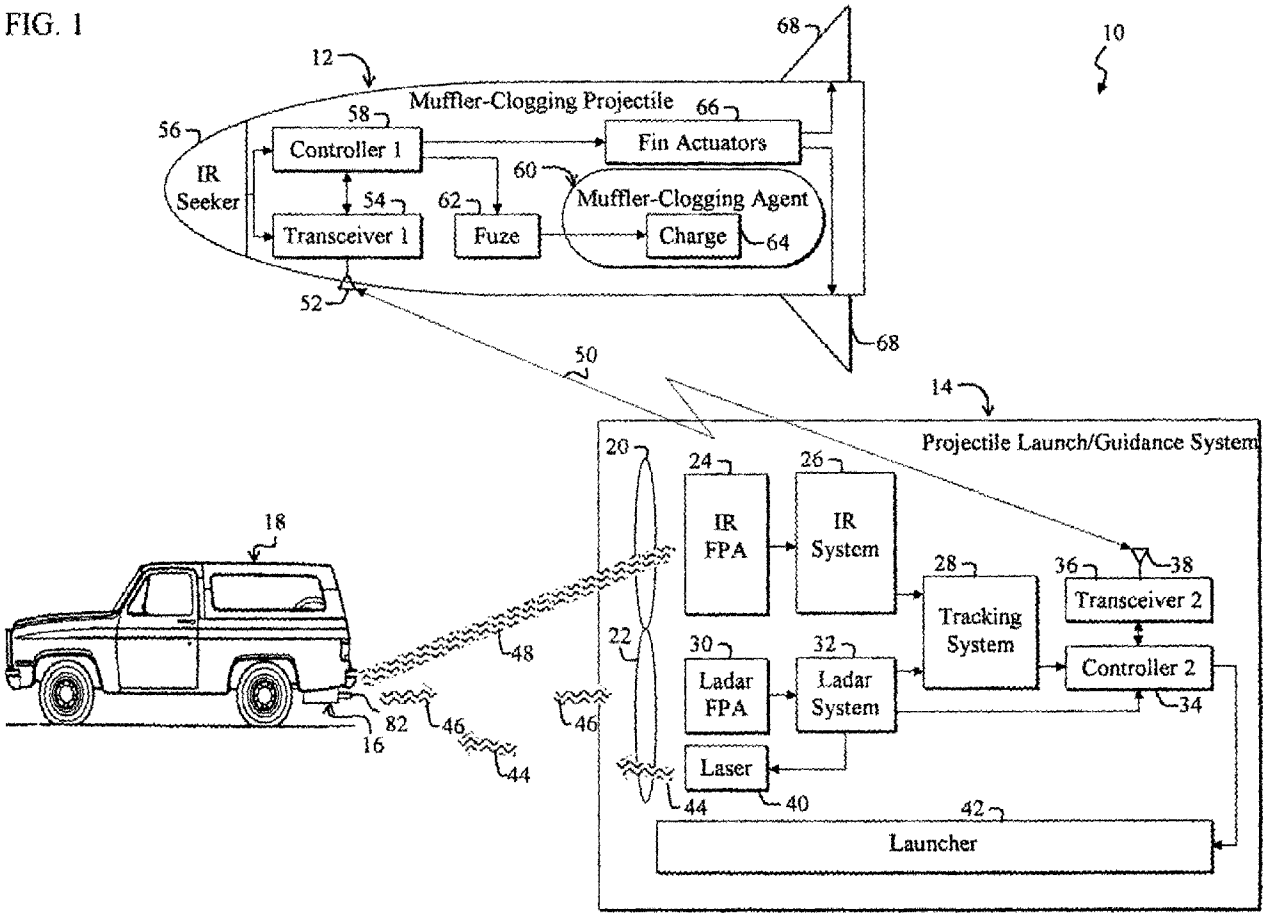
FIG. 1 is a diagram of a system for selectively disabling a vehicle via a muffler-clogging projectile according to an embodiment of the present invention.

FIG. 1 is a diagram of a system 10 for selectively disabling a vehicle 18 via a muffler-clogging projectile 12 according to an embodiment of the present invention. For clarity, various components, such as power supplies, amplifiers, integrated circuit chips, and so on, have been omitted from the figures. However, those skilled in he art with access to the present teachings will know which components to implement and how to implement them to meet the needs of a given application.

The system 10 includes a projectile launch/guidance system 14 in communication with the projectile 12. The projectile launch/guidance system 14 is adapted to launch and guide the muffler-clogging projectile 12 toward the muffler 16 of the vehicle 18.

The projectile launch/guidance system 14 includes an infrared aperture 20 and a laser radar (ladar) system aperture 22. An Infrared (IR) Focal Plane Array (FPA) 24 of infrared energy detectors is positioned adjacent to the infrared aperture 20 through which infrared energy is received from a scene containing the vehicle 18. The IR FPA 24 provides input to an IR system 26, which performs IR image processing of the scene. The IR system 26 provides input to a tracking system 28. The tracking system 28 also receives input from a ladar system 32, which receives input from a ladar FPA 30, which is positioned to receive laser energy via the ladar system aperture 22. The ladar system 32 also communicates with a laser 40, which selectively illuminates the scene containing the vehicle 18 via laser pulses 44. Laser pulses 44 reflecting from the scene containing the vehicle 18 are called laser returns 46. The laser returns 46 pass through the ladar aperture 22 to the ladar FPA 30.

The tracking system 28 provides input to a launch/guidance controller (controller 2) 34, which also receives range input directly from the ladar system 32. The launch/guidance controller 34 communicates with a launch/guidance transceiver (transceiver 2) 36, which has an antenna 38 for communicating with the projectile 12 via a radio signal 50. The launch/guidance controller 34 also provides control input to a launcher 42, which is capable of launching the muffler-clogging projectile 12.

In the present specific embodiment, the muffler-clogging projectile 12 includes an IR seeker 56, which provides input to a projectile controller (controller 1) 58 and a projectile transceiver (transceiver 1) 54 having an accompanying projectile antenna 52. The projectile controller 58 provides input to a fuze 62 and projectile-steering actuators 66, which control projectile steering fins 68.

The fuze 62 provides a charge-activation signal to an explosive charge 64, which is surrounded by a muffler-clogging agent 60. The fuze 62 may be embedded within the muffler-clogging agent 60 and positioned adjacent to the charge 64. The charge-activation signal may be a pressure wave or heat generated by an initiating charge (not shown) positioned within the fuze 62.

In operation, the projectile launch/guidance system 14 views the scene containing the vehicle 18 through the apertures 20, 22 via the FPA's 24, 30, which detect electromagnetic energy 46, 48 received from the scene. The construction details of suitable FPA's are known in the art, and one skilled in the art may readily select an appropriate FPA to meet the needs of a given application.

The FPA's 24, 30 detect electromagnetic energy and provide electrical signals in response thereto to the IR system 26 and the ladar system 32, respectively. In the present embodiment, the systems 26, 32 are imaging systems. The IR system 26 constructs an infrared image of the scene containing the vehicle 18 and muffler 16 based on the infrared energy 48 emanating from the scene. Typically, the muffler 16 will provide a distinct heat signature, which may be readily illustrated by the IR system 26. Tracking heat emanating from the muffler 16 facilitates targeting at night, where passive visual systems may be compromised.

The ladar system 32 also constructs an image of the scene containing the vehicle 18. The ladar system 32 selectively causes the laser 40 to fire the laser pulses 44 toward the vehicle 18, thereby illuminating the vehicle 18. The return pulses 46 contain image information about the scene containing the vehicle 18. Furthermore, by computing the time difference of arrival between when the pulses 44 are fired and the corresponding pulses 46 are received, the distance between the projectile launch/guidance system 14 and the muffler 16 may readily be computed based on the speed of light. Accordingly, the ladar system 32 provides both imaging information and range information.

Imaging information from the IR system 26 and from the ladar system 32 is provided to the tracking system 28, which more precisely determines the position of an aperture 82 of the muffler 16 therefrom. The tracking system 28 may include matched filters, velocity filters, and/or other modules (not shown) to facilitate target detection, i.e., muffler-aperture location detection. Precise target location information or a prediction thereof is forwarded to the launch/guidance controller 34 in real time. Muffler aperture range information is also forwarded from the ladar system 32 to the launch/guidance controller 34.

The launch/guidance controller 34 may receive additional input from a user-interface (not shown), which may be employed by operators to selectively enable and/or control the operation of the projectile launch/guidance system 14. When the projectile launch/guidance system 14 is enabled, the launch/guidance controller 34 determines when the muffler aperture 82 (target) is within range of the projectile launch/guidance system 14 based on range information from the ladar system 32.

When the target 82 is within adequate range of the projectile launch/guidance system 14, the launch/guidance controller 34 activates the launcher 42, which launches the muffler-clogging projectile 12 toward the muffler 16. The projectile launch/guidance system 14 may be mounted on a gimbal (not shown) to facilitate properly orienting the launcher 42 so that the projectile 12 may be more effectively aimed at the muffler 16. Furthermore, the projectile launch/guidance system 14 may be mounted on a pursuing vehicle, such as a helicopter, police car, or military vehicle. Those skilled in the art with access to the present teachings will know how to design and implement or otherwise obtain user-interfaces and gimbals to meet the needs of a given application and without undue experimentation.

In an alternative implementation, the launcher 42 is mounted separately from the projectile launch/guidance system 14, such as on a helicopter or along the side of a road. Such a remotely positioned launcher may be wirelessly controlled.

When the projectile 12 is flying toward the muffler 16, the IR seeker 56 on the projectile 12 zeros in on the location of the muffler 16. The projectile controller 58 selectively controls the steering fins 68 via the steering actuators 66 based on information received from the IR seeker 56 and based on information received by the projectile transceiver 54 from the projectile launch/guidance system 14. The transceiver 52 may also forward information from the IR seeker 56 to the launch/guidance controller 34 on the launch/guidance system 14 to enhance guidance controls forwarded to the projectile controller 58 from the launch/guidance controller 34 via the transceivers 36, 54.

In the present illustrative embodiment, the projectile controller 58 employs an algorithm to optimally combine information from the IR seeker 56 and the transceiver 54 to accurately steer the projectile 12. Those skilled in the art may readily implement customized algorithms to combine the information from the transceiver 54 and the IR seeker 56 as required for a given application. In some implementations, the transceivers 54 and 36 are omitted, and projectile steering after the projectile 12 is launched is performed solely based on information received by the projectile controller 58 from the IR seeker 56. Furthermore, those skilled in the art will appreciate that the IR seeker 56 may be implemented as another type of seeker, such as a hybrid infrared, sonar, microwave, radar, and/or ladar seeker.

The transceiver 54 may act as a vehicle-locating device upon sticking to or lodging within the muffler 16. The transceiver 54 may incorporate Global Positioning System (GPS) functionality so that the location of the vehicle 18 may be readily tracked via location signals transmitted from the projectile transceiver 54.

Those skilled in the art will appreciate that other types of targeting technologies, such as sonar techniques, may be employed without departing from the scope of the present invention. For example, the ladar equipment 30, 32, 40 on the projectile launch/guidance system 14 may be replaced with radar equipment without departing from the scope of the present invention. Furthermore, the IR seeker 56 may be replaced with another type of seeker, or the seeker 56 may be omitted.

In the present embodiment, the projectile controller 58 receives timing information from the projectile launch/guidance system 14 via the projectile transceiver 54. The timing information is based on the initial measured distance between the projectile launch/guidance system 14 and the muffler 16 as measured by the ladar system 32 and is based on the kinematic properties of the projectile flight, which are approximately governed by the following well-known equation:

$$P = \frac{1}{2}at^2 + v_o t + P_o, \qquad [1]$$

where t is time; P is the current position; a represents projectile acceleration; $v_o$ is the initial velocity; and $P_o$ is the initial position of the projectile 12. The timing information is employed by the projectile controller 58 to selectively trigger activation of the fuze 62, which detonates the charge 64, thereby dispersing the muffler-clogging agent 60 on, over, or within the muffler 16.

The projectile controller 58 may employ equation (1) in combination with initial range information from the launch/guidance system 14 to compute the distance between the projectile 12 and the muffler 16 to facilitate timing of activation of the fuze 62. Other timing methods may be employed without departing from the scope of the present invention.

In some implementations, the muffler-clogging agent 60 is designed to disperse over the muffler 16, thereby covering the muffler aperture, as discussed more fully below. In other applications, the muffler-clogging agent 60 lodges within the muffler 16 or aperture thereof.

In an alternative implementation, the fuze 62 does not receive input from the controller 58, and instead is a microelectromechanical (MEMS) or nanosystems fuze that arms upon launch setback acceleration and triggers upon impact with the muffler 16. An exemplary MEMS safe-and-arm device is disclosed in U.S. Pat. No. 6,167,809, entitled ULTRA-MINATURE, MONOLITHIC MECHANICAL SAFETY-AND-ARMING DEVICE FOR PROJECTED MUNITIONS, by Charles H. Robinson et al, the teachings of which are herein incorporated by reference. Those skilled in the art with access to the present teachings may readily implement a suitable fuze without undue experimentation.

Furthermore, in some implementations, the muffler-clogging projectile 12 is fitted with wings that may have accompanying control surfaces (not shown) on the projectile 12 to enable relatively slow projectile flight toward the muffler 16 before the muffler-clogging agent 60 is dispersed on or within the muffler 16. Relatively slow projectile flight in combination with winged control surfaces may provide more time for the projectile 12 to seek and steer toward the muffler 16 and may enhance safety, especially when hard-surfaced projectiles are employed. Implementation of slow-flying projectiles or fast-flying projectiles is application-specific and may be determined by those skilled in the art to meet the needs of a given application.

The steering fins 68 may be replaced by another type of actuator, such as micro thrusters or charges that are selectively detonated to create desired directional changes in the motion of the projectile 12. An exemplary micro-actuator is disclosed in U.S. Pat. No. 6,105,503, by Baginski, issued Aug. 22, 2000, entitled ELECTRO-EXPLOSIVE DEVICE WITH SHAPED PRIMARY CHARGE, the teachings of which are herein incorporated by reference.

The projectile 12 may be constructed in a gelatinous housing so that in the unlikely event that the projectile misses the muffler 16, it will not result in injury or other collateral damage.

Hence, the system 10 is an effective system for disabling a vehicle, such as the truck 18, during pursuit or a high-speed chase. This system 10 improves upon the current state of the art by not requiring special equipment to be installed on the fleeing vehicle and by not allowing the criminal to park and escape before the police converge on the scene. By firing the heat-seeking projectile 12 toward the tailpipe 16 of the automobile 18 and thereby plugging the tailpipe and suffocating the engine, the engine of the vehicle 18 stalls. The projectile 12 may be contained in a glue or other sticky gelatinous material that disposes around the tailpipe 16.

Alternatively, a detonator 62, 64 within the projectile 12 activates in response to the projectile travel time with reference to range information determined by the launch/guidance system 14 to determine just the right time to detonate, releasing a wall of clogging-agent from within the projectile 12, which is sufficient to coat the muffler 16, sealing the muffler aperture 82. Various other projectiles may be employed without departing from the scope of the invention. Side firing of the projectile 12 is enabled to account for horizontally mounted tail pipes (not shown). However, the clogging-agent 60 may still wrap around the side of such tailpipes when fired from the rear of the associated vehicles and may be sufficient to stop or at least slow the suspect vehicle 18.

Figure 2:
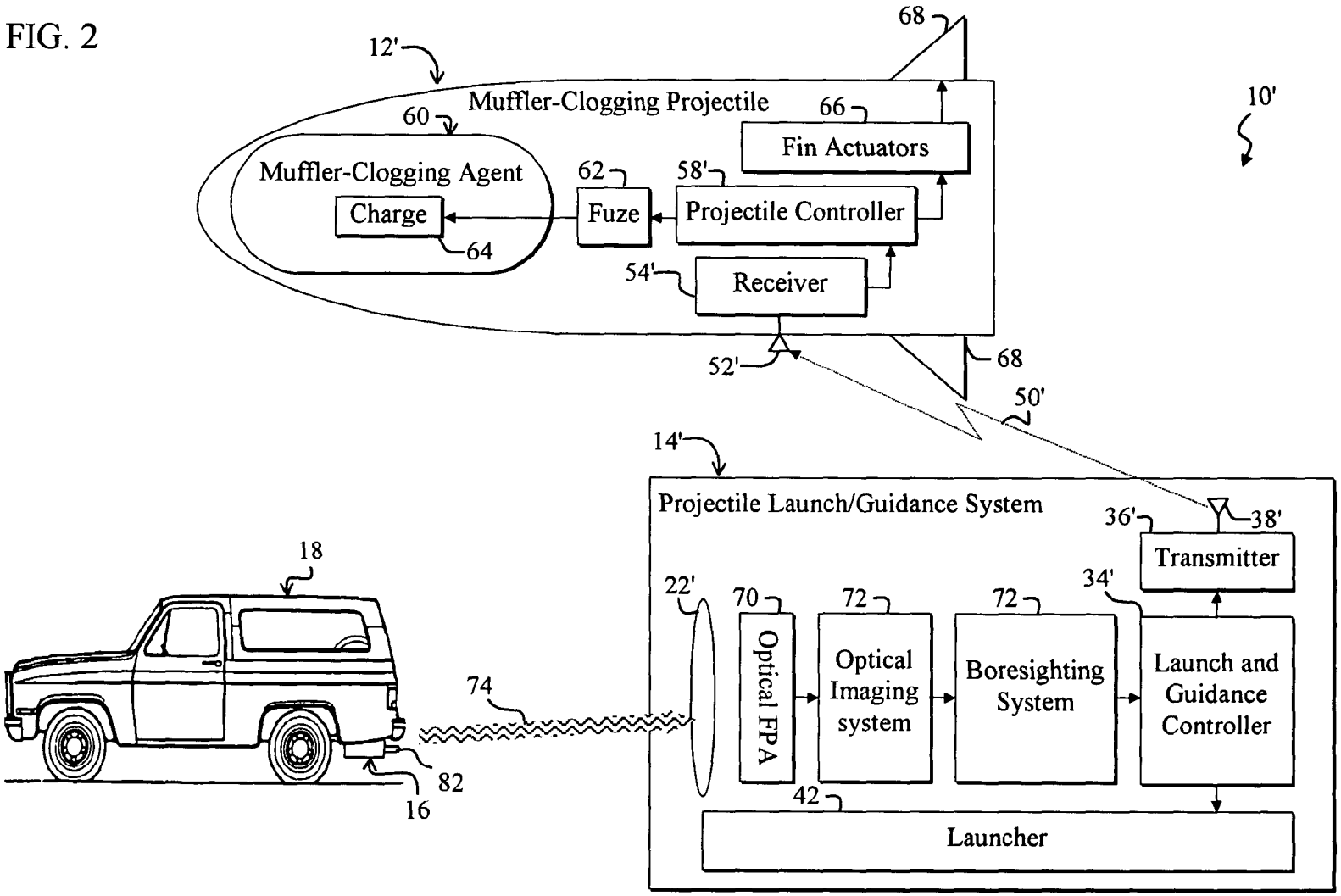
FIG. 2 is a diagram of an alternative embodiment of a system for selectively disabling a vehicle.

FIG. 2 is a diagram of an alternative embodiment of a system 10' for selectively disabling the vehicle 18. The alternative muffler-clogging projectile 12' is similar to the muffler-clogging projectile 12 of FIG. 1, with the exception that the IR seeker 56 of FIG. 1 is omitted, and the projectile transceiver 54 and accompanying antenna 52 of FIG. 1 are replaced with a receiver 54' and antenna 52' in FIG. 2. The infrared and ladar components 20-32, 40 of the launch/guidance system 14 of FIG. 1 are omitted in the system 10' FIG. 2.

The alternative launch/guidance system 14' employs an optical aperture 22' for receiving optical energy 74 from the scene containing the muffler 16. An optical FPA 70 converts the received optical energy 74 into an electrical signal, which is forwarded to an optical imaging system 72. The optical imaging system 72 constructs an image of the vehicle 18 and muffler 16 based on the received optical energy 74. The resulting image information is forwarded to a boresighting system 72.

The boresighting system 72 includes a user-interface (not shown) that enables a user to guide the projectile 12' toward the muffler 16 by aligning a boresight (crosshairs) with the muffler 16. The boresight location of the image information received from the optical imaging system 72 is employed by an accompanying launch and guidance controller 34' to generate control signals 50' effective to guide the muffler-clogging projectile 12' toward the muffler 16 when the location of the muffler 16 is aligned with the boresight. The control signals are transmitted via a launch/guidance transmitter 36' and accompanying antenna 38'. The projectile receiver 54' then forwards the control signals to the projectile controller 58', which controls activation of the fuze 62 and fin steering actuators 66 accordingly in response thereto.

The launcher 42 may be manually activated via the user-interface of the boresighting system 72. The projectile launch/guidance system 14' may be mounted on a manually controlled gimbal and/or an automatically controlled gimbal (not shown) to facilitate initial projectile aiming.

Those skilled in the art may employ other types of guidance systems and techniques, such as Tube-launched Optically-tracked, Wire-guided (TOW) methods, which may employ beacons placed on the projectile 12'. Furthermore, guidance systems employing Inertial Reference Units (IRU's) or Inertial Measurement Units (IMU's) may be employed without departing from the scope of the present invention. In addition, the optical components 22', 70, 72 may be replaced with other types of components, such as infrared components. Those skilled in the art will know which components to implement to meet the needs (such as budget requirements) of a given application.

Alternative projectiles may be guided in accordance with various other well-known guidance techniques, such as those disclosed in U.S. Pat. No. 6,565,036, entitled TECHNIQUE FOR IMPROVING ACCURACY OF HIGH SPEED PROJECTILES, the teachings of which are herein incorporated by reference, without departing from the scope of the present invention.

Figure 3:
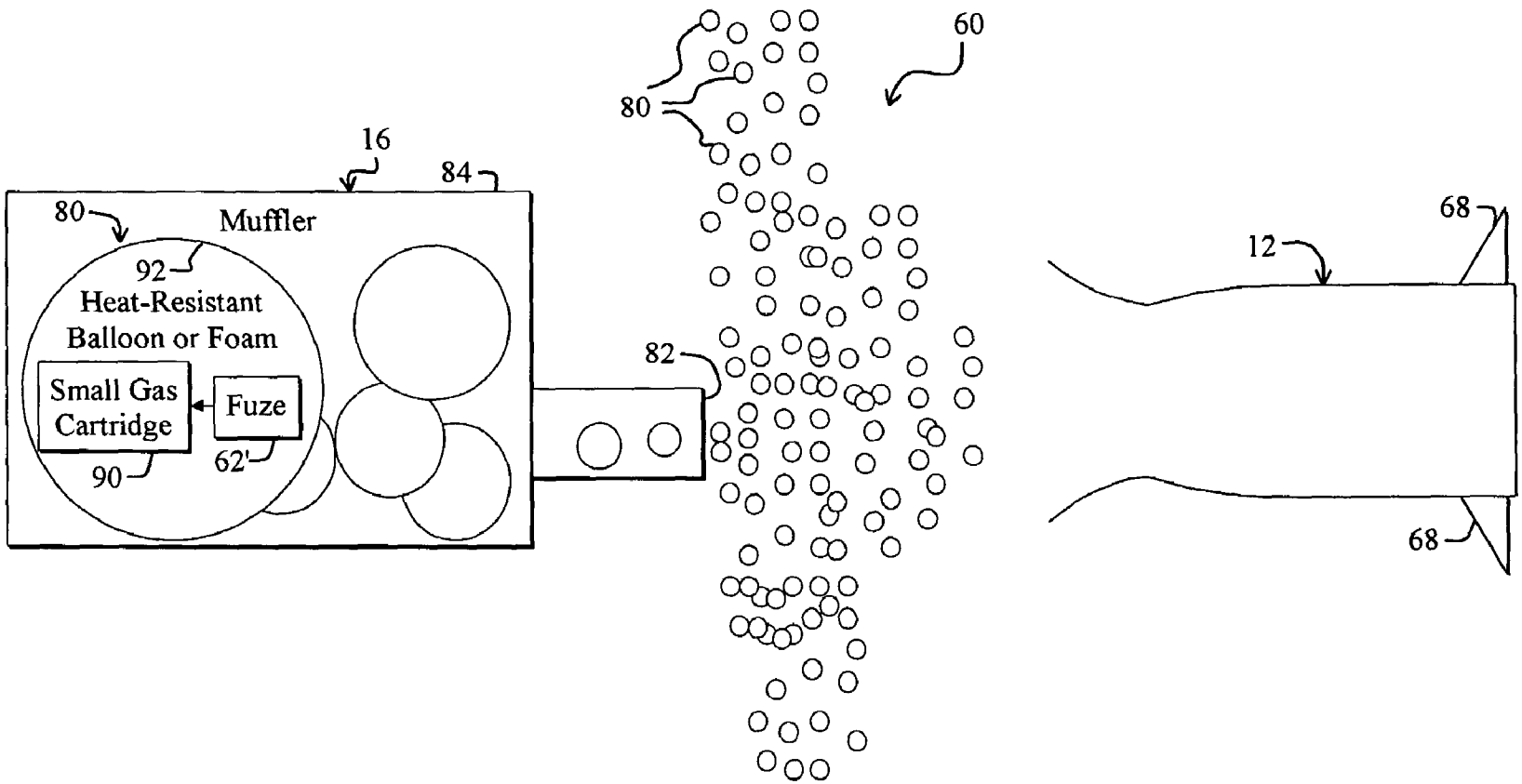
FIG. 3 is a diagram illustrating a muffler-clogging agent suitable for use with the projectiles of FIGS. 1 and 2.

FIG. 3 is a diagram illustrating a muffler-clogging agent 60 suitable for use with the projectiles 12, 12' of FIGS. 1 and 2. With reference to FIGS. 1 and 3, the muffler-clogging agent 60 is selectively dispersed from the projectile 12 in response to activation of the charge 64 when the projectile 12 is sufficiently close to the muffler 16.

In the present specific embodiment, the muffler-clogging agent 60 includes plural beads 80, which can readily enter an aperture 82 of the muffler 16. The beads 80 enter a main body 84 of the muffler 16 via the muffler aperture 82 and begin to expand. The beads 80 each include a small gas cartridge 90 in communication with a micro-fuze 62', which are surrounded by a durable balloon, foam, or other material that expands upon activation of the small gas cartridge 90 in response to an activation signal from the fuze 62'. The fuze 62' may be a temperature-sensitive fuze that triggers in response to heat from the muffler 16. Alternatively, the fuze 62' arms in response to setback acceleration from the launch of the projectile 12 and/or from activation of the dispersing charge 64 and then activates upon sensing impact with the muffler 16. Alternatively, the fuze 62' incorporates a receiver (not shown) and is remotely activated via the launch/guidance system 10. When the fuze 62' activates, it causes the small gas cartridge 90 to release pressurized gas, which expands the surrounding coating 92, thereby expanding the beads 80. The beads lodged within the muffler body 84 are designed to sufficiently expand to block the muffler aperture 82.

In the present embodiment, some of the beads 80 are designed to rupture once inside the muffler body 84. These beads contain a special gas within the small gas cartridge 90. This special gas is sufficient to trigger engine stall when it diffuses back through the muffler system to the engine cylinders (not shown) of the vehicle 18. A suitable gas may include a trifluoroidomethane mixture with an inert atmospheric buoyant gas such as helium as disclosed in U.S. Pat. No. 5,848,650, VEHICULAR ENGINE COMBUSTION SUPPRESSION METHOD, by Brian B. Brady, the teachings of which are herein incorporated by reference.

Any diffusion of such gas back to the cylinders will promote engine stall. Furthermore, the projectile 12 may be fired at the front of the vehicle 18 being pursued. Impact with the cars front grill will trigger the fuze to release the gas, which will pass into the engine air intake, thereby stalling the engine.

In some implementations, the beads 80 are designed to penetrate the walls of the muffler body 84 rather than entering through the aperture 82. When the beads 80 expand upon penetrating the muffler body 84, they plug the holes created therein. In other implementations, the projectile 12 passes to the side or underneath the muffler and ejects the beads 80 sideways or upward to facilitate plugging side-facing or downward-facing tailpipes.

In an alternative implementation, the projectile 12 is launched toward a front of the vehicle 18. The clogging agent 60 then disperses within the air intake of the vehicle 18 or attaches to the front grill, which triggers release of the engine-stalling gas from the gas cartridge 90. The engine-stalling gas will then suffocate the engine of the vehicle 18. Alternatively, expansion of the beads 80 may sufficiently plug the air intake to cause the vehicle 18 to stall.

Hence, embodiments of the present invention often cause the engine of a fleeing vehicle, such as the vehicle 18, to stall by controlling the fuel/air mixture in the combustion chambers of the accompanying engine via direct suffocation by plugging the muffler 16 or air intake (not shown) and/or by gas that suffocates the engine or otherwise compromises the fuel/air mixture.

In an alternative embodiment, the muffler-clogging agent 60 may be built into the muffler 16 or air intake and remotely activated by law-enforcement other pursuing agents. Prepositioning the disabling mechanism 60 within the muffler 16 or air intake decreases tampering likelihood, as it cannot be seen unless the muffler 16 is destroyed. Activation may be implemented via a directional signal transmitted by authorities and received by a receiver (not shown) included in the fuze 62'. By aiming the directional signal at the muffler 16, authorities may selectively disable the desired automobiles even when they are positioned among several other automobiles. Various directional signals that may be employed include laser beams, microwave beams, and so on. In implementations employing laser beams, the fuze receiver (not shown) will likely include a photodetector (not shown) responsive to a particular beam signature. The photodetector will be positioned within the muffler 16 so that laser light can reach the detector. This may require use of reflective surfaces interior to the muffler 16.

Figure 4:
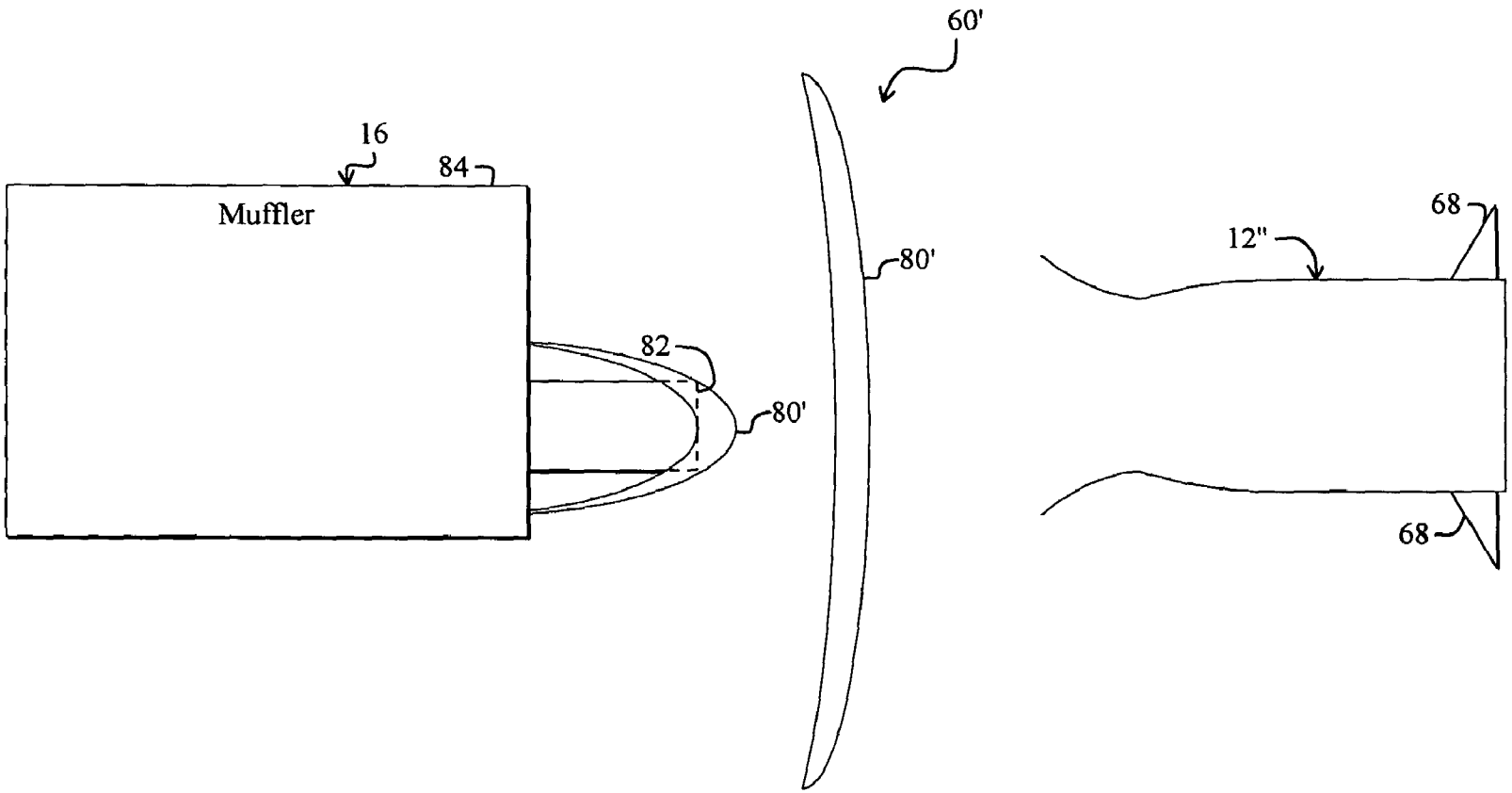
FIG. 4 is a diagram illustrating an alternative muffler-clogging agent suitable for use with the projectiles of FIGS. 1 and 2.

FIG. 4 is a diagram illustrating an alternative muffler-clogging agent 60' suitable for use with the projectiles of FIGS. 1 and 2. With reference to FIGS. 2 and 4, the clogging agent 60' includes paddies 80' of a sticky/pliable substance sufficient to stick to the muffler 16 and seal the muffler aperture 82. The paddies 80' may be constructed from hardening glue that hardens quickly when heated by the muffler 16.

In some applications, the paddies 80' may be made sufficiently large to coat the entire rear end of a fleeing vehicle, such as the vehicle 18 of FIGS. 1 and 2, including the muffler 16. In systems employing such large paddies, projectile guidance and launch control mechanisms may be less stringent, due to a larger margin for error. By selectively detonating the charge 64 to release the muffler-clogging agent 60' from an accompanying alternative projectile 12" within a predetermined range of the muffler 16, the effective surface area of the clogging agent 60' expands to ensure that the muffler 16 is properly coated to block exhaust gases from exiting the muffler 16.

Thus, the present invention has been described herein with reference to particular embodiments for particular applications. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

Accordingly,

What is claimed is:

1. A system for selectively disabling a vehicle comprising:
first means for locating a vehicle to be disabled;
second means for launching a disabling projectile toward said vehicle; and
third means for suffocating an engine of said vehicle via said projectile, thereby disabling said vehicle.

2. The system of claim 1 wherein said third means includes fourth means for plugging a muffler of said vehicle, said fourth means including a muffler-plugging agent incorporated within said projectile.

3. The system of claim 2 wherein said system further includes fifth means for guiding said projectile toward said muffler.

4. The system of claim 3 wherein said fifth means includes an infrared guidance system.

5. The system of claim 1 wherein said third means includes a gas or beads incorporated within said projectile, said gas or beads being sufficient to stall said vehicle upon or after entering an engine of said vehicle.

6. The system of claim 5 wherein said system further includes sixth means for selectively dispersing said gas or beads upon or after impact of said projectile with said vehicle.

7. The system of claim 6 wherein said projectile includes a sticky substance for adhering said projectile to said vehicle.

8. The system of claim 7 wherein said system further includes seventh means for directing said projectile into an aperture of said muffler, thereby at least partially plugging said muffler.

9. A system for disabling a vehicle comprising:
a muffler-clogging agent and
means for selectively activating said muffler-clogging agent to effect clogging of a muffler of said vehicle in response to a predetermined condition.

10. The system of claim 9 further including means for directing a projectile containing said muffler-clogging agent toward said target.

11. The system of claim 10 wherein said means for directing includes a targeting and guidance system employing infrared energy emanating from said muffler, and wherein said system further includes a controller in communication with said targeting and guidance system for providing control signals to control steering actuators positioned on or within said projectile.

12. The system of claim 11 wherein said means for selectively activating includes a fuze.

13. The system of claim 10 wherein said muffler-clogging agent includes plural muffler-clogging beads capable of expanding upon entering an aperture of said muffler, thereby clogging said muffler, whereby said vehicle is slowed or disabled.

14. The system of claim 10 wherein said muffler-clogging agent includes hardening glue or a sticky gelatinous material.

15. A system for disabling a vehicle comprising:
a muffler-clogging agent incorporated within a projectile;
means for directing said projectile toward a muffler of said vehicle, wherein said means for directing includes
a targeting and guidance system employing infrared energy emanating from said muffler, wherein said system further includes
a controller in communication with said targeting and guidance system for providing control signals to control steering actuators positioned on or within said projectile; and
means for selectively activating said muffler-clogging agent to effect clogging of a muffler of said vehicle in response to a predetermined condition, said means for selectively activating including a Micro Electromechanical Systems (MEMS) fuze that is armed upon launch of said projectile and activated upon impact of said projectile with said muffler.

16. The system of claim 15 wherein said fuze is a remote-controlled fuze responsive to a signal front said controller.

17. A system for selectively disabling a vehicle comprising:
first means for determining a location of a muffler of said vehicle;
second means for launching a projectile toward said muffler; and
third means for clogging said muffler via said projectile.

18. The system of claim 17 further including fourth means for guiding said projectile to said muffler based on said location of said muffler as determine by said first means.

19. The system of claim 18 wherein said first means includes a tracking system remotely positioned relative to said projectile, said tracking system capable of tracking the location of said muffler and providing a signal in response thereto.

20. The system of claim 19 wherein said fourth means further includes means for receiving said signal, said means for receiving said signal positioned on said projectile and capable of controlling the direction of flight of said projectile based on said signal.

21. A system for selectively disabling a vehicle comprising:
first means for launching a projectile toward said muffler;
second means for determining a location of a muffler of said vehicle, wherein said first means includes
a target tracking system remotely positioned relative to said projectile, said target tracking system capable of tracking said location of said muffler and providing a signal in response thereto and an infrared imaging system for receiving infrared energy from a scene containing said muffler and providing an infrared image in response thereto to said tracking system;

third means for guiding said projectile to said muffler based on said location of said muffler as determined by said second means, wherein said third means further includes fourth means for receiving said signal, said fourth means positioned on said projectile and capable of controlling a direction of flight of said projectile based on said signal; and fifth means for clogging said muffler via said projectile.

22. The system of claim 18 wherein said third means includes a muffler-clogging agent on or within said projectile that includes plural beads, said beads including means for expanding upon lodging within said muffler, thereby sufficiently restricting exhaust flow from said muffler to cause said vehicle lose power and/or stall.

23. The system of claim 22 wherein said plural beads each include a fuze in communication with a container containing pressurized gas and surrounded by a material that expands upon release of said pressurized gas in response to activation by said fuze.

24. The system of claim 23 wherein said fuze is impact-sensitive, temperature-sensitive, or responsive to remote activation signals.

25. The system of claim 22 wherein said third means includes a fuze in communication with a charge, said charge sufficient to disperse said muffler-clogging agent from said projectile in response to activation by said fuze.

26. A system for selectively disabling a vehicle comprising:

first means for launching a projectile toward a muffler of said vehicle;

second means for determining a location of said muffler, said first means including an infrared seeker installed on said projectile, said infrared seeker capable of tracking said location of said muffler based on heat emanating from said muffler;

third means for guiding said projectile to said muffler based on said location of said muffler as determine by said second means, said third means including fourth means for controlling a trajectory of said projectile via one or more steering actuators positioned on said projectile, said fourth means responsive to control signals based on output from said infrared seeker; and fifth means for clogging said muffler via said projectile.

27. The system of claim 21 wherein said first means includes a ladar or radar system for providing additional image information pertaining to said scene, said additional image information including distance information, and further including sixth means for employing said distance information to selectively activate said projectile.

28. A system for selectively disabling a vehicle comprising:

first means for determining a location of a muffler of said vehicle;

second means for launching a projectile toward said muffler;

third means for guiding said projectile to said muffler based on said location of said muffler as determine by said first means, wherein said third means includes a boresight guidance system that includes an imaging system in communication with a controller, said controller forwarding guidance signals to a receiver on said projectile for controlling actuators on said projectile to steer said projectile toward a boresight of said imaging system, said boresight approximately aligned with said muffler; and fourth means for clogging said muffler via said projectile.

29. A system for selectively disabling a vehicle comprising:

first means for determining a location of a muffler of said vehicle;

second means for launching a projectile toward said muffler;

third means for guiding said projectile to said muffler based on said location of said muffler as determine by said first means; and fourth means for clogging said muffler via said projectile, said fourth means including a muffler-clogging agent on or within said projectile that includes plural beads, said beads including means for expanding upon lodging within said muffler, thereby sufficiently restricting exhaust flow from said muffler to cause said vehicle lose power and/or stall;

wherein said muffler-clogging agent further includes foam or sponge material and/or a substance that hardens in response to heat from said muffler and/or said charge; and a fuze in communication with a charge, said charge sufficient to disperse said muffler-clogging agent from said projectile in response to activation by said fuze.

30. A system for selectively disabling a vehicle comprising:

first means for locating a vehicle to be disabled;

second means for adhering a disabling projectile to said vehicle; and third means for suffocating an engine of said vehicle via said projectile, thereby disabling said vehicle.

* * * * *